United States Patent [19]

Tunick

[11] 4,399,939

[45] Aug. 23, 1983

[54] CARAMEL OR CANDY APPLE CARTON

[75] Inventor: Abraham L. Tunick, Rock Island, Ill.

[73] Assignee: Karmelkorn Shoppes, Inc., Rock Island, Ill.

[21] Appl. No.: 338,472

[22] Filed: Jan. 11, 1982

[51] Int. Cl.[3] ..... B65D 5/46; B65D 85/34

[52] U.S. Cl. ..... 229/52 B; 229/40; 229/44 R

[58] Field of Search ..... 229/52 B, 52 BC, 40, 229/44 R, 26, 16 D, 34 R

[56] References Cited

U.S. PATENT DOCUMENTS

| | | | |
|---|---|---|---|
| 1,910,168 | 5/1933 | Jacobs | 229/52 B |
| 1,934,218 | 11/1933 | Webb | 229/34 |
| 2,333,560 | 11/1943 | Gray | 229/52 BC |
| 2,732,983 | 1/1956 | Siddall | 229/52 BC |
| 3,198,378 | 8/1965 | Fauquhar | 229/52 B |
| 3,339,820 | 9/1967 | Krazyzanowski | 229/52 B |
| 3,640,380 | 2/1972 | Huffman | 229/52 B |
| 3,698,625 | 10/1972 | Graser | 229/52 B |
| 4,184,595 | 1/1980 | Wackerman | 229/52 BC |

*Primary Examiner*—Herbert F. Ross

*Attorney, Agent, or Firm*—Gary, Juettner & Pyle

[57] ABSTRACT

A paperboard carton for containing, holding and carrying a plurality of caramel or candy coated apples, while minimizing surface contact between the apples and the carton, comprises an integral carton flat consisting essentially of a bottom panel having two U-shaped slits near its ends which form tabs directed toward its ends, side panels integral with the side edges of the bottom panel folded upward, outward and then progressively inward to form the sides and top of the carton, corner flaps integral with the lower portion of the side panels folded inward, end panels integral with the ends of the bottom panel folded up and over the corner flaps and interlocked into the tabs in the bottom panel, and handle panels integral with the upper edges of the side panels having hand holes therein and sandwiching therebetween the free ends of the sticks in the apples for holding them in place.

1 Claim, 2 Drawing Figures

CARAMEL OR CANDY APPLE CARTON

BACKGROUND OF THE INVENTION

The present invention relates to cartons for holding and carrying a plurality of food products.

It is often necessary in the food products industry to package several items of a given kind in one carton for the convenience of consumers. Paperboard cartons, boxes and blanks have been used for packaging bottles, cans and other types of containers for food products. These cartons are customarily stamped from a single blank and folded to enclose and contain a plurality of smaller food product containers. The convential carton is customarily provided with finger holes on its sides or top to facilitate carrying of the carton and its contents.

While the conventional carton suffices for bottles and cans, it cannot be used to contain, hold and carry caramel or candy coated apples. The side and end panels of conventional cartons tend to come into contact with the products contained therein. With caramel or candy apples it is best to minimize the contact between the carton and the apples, as the caramel or candy coating is very sticky and tends to adhere to paperboard cartons.

SUMMARY OF THE INVENTION

An object of the present invention is to provide a carton for containing, holding and carrying a plurality of caramel or candy coated apples while minimizing the surface contact between the caramel or candy coating on the apples and the interior surface of the carton. Further objects of the invention are to provide a carton which may be stamped from a single paperboard blank and which may be easily and quickly folded into the finished carton.

More particularly, the carton of the present invention comprises a unitary or integral paperboard blank which is cut and scored to define and to consist essentially of a bottom panel, two side panels integral with the side edges of the bottom panel and foldable along said edges at score lines therein, two pairs of corner flaps integral with the lower portion of the side panels and foldable at score lines, two end panels integral with the ends of the bottom panel and foldable at score lines, and two handle panels integral with the upper edges of the side panels and foldable at score lines. The side panels each have two score lines lengthwise therein dividing the side panels into lower, middle and upper portions; the lower portion being folded upwardly and outwardly from the bottom panel, the middle portion being folded to extend inwardly and primarily upwardly from the lower portion, and the upper portion extends upwardly and primarily inwardly from the middle portion, whereby the side panels extend around and over the caramel or candy coated apples without coming into contact with the same.

The corner flaps are folded inwardly, perpendicular to the lower portion of the side panels. The end panels are folded upwardly, over the corner panels and then downwardly to the bottom panel. The ends of the end panels have tongue portions which are fitted underneath tabs formed by cuts in the bottom panel to lock the end panels into position, and by virtue of the relationship of the end panels, corner flaps and side panels to lock the carton in set-up condition. The end panels as folded form a tray-like bottom for the caramel and candy apples, extending only as high as the lower portion of the side panels, thus leaving open the space above the end panels, adjacent the middle and upper portions of the side panels, to permit the consumer to view the caramel or candy apples without opening the carton.

The handle panels are folded vertically upward from the upper edges of the side panels. The handle panels sandwich therebetween the sticks in the caramel or candy apples, and when fastened together hold the sticks so that the caramel or candy apples are restrained from sliding or tipping into contact with the side panels or end panels. The handle panels also have oval shaped hand holes cut therein to provide a convenient handle for carrying the carton and the apples.

DETAILED DESCRIPTION OF THE INVENTION

Figure 1:
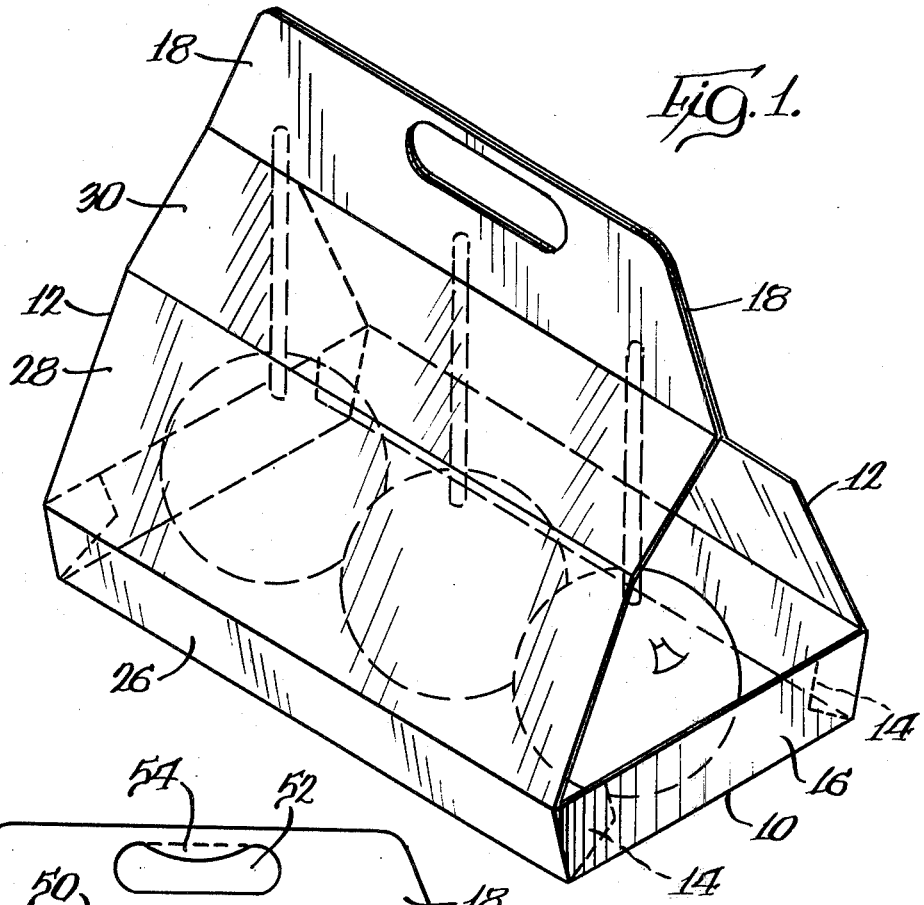
FIG. 1 is a perspective view of the carton showing the carton in finished, set-up condition and containing and holding three caramel or candy apples.
Figure 2:
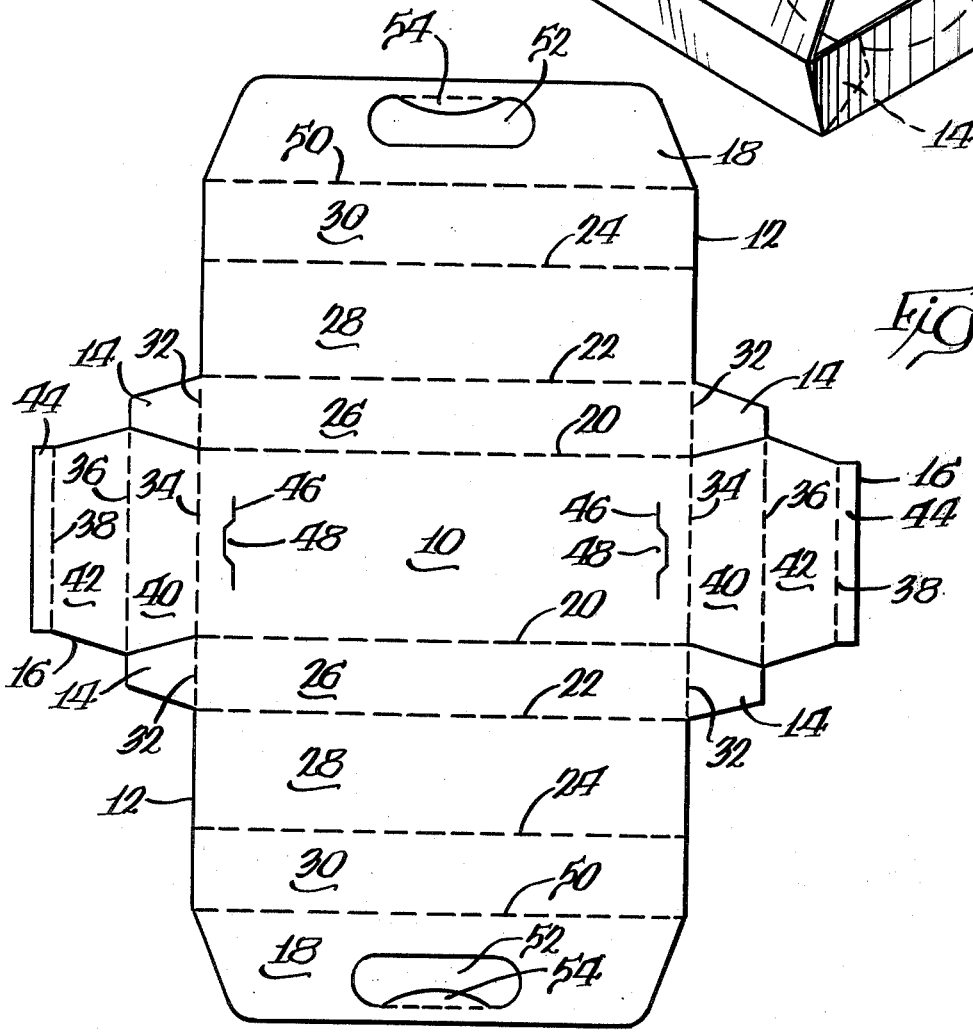
FIG. 2 is a plan view of the carton flat or blank before being folded, and illustrating the cut and score lines therein.

The carton blank of the invention is preferably stamped in conventional manner from paperboard stock. However, it is appreciated that the blank can be stamped or cut from any foldable material such as plastic, for example. The carton consists essentially of a bottom panel 10, two side panels 12, two pairs of corner flaps 14, two end panels 16 and two handle panels 18. As shown in FIG. 2, the side panels 12 are integral with the side edges of the bottom panel 10 and are foldable therewith at score lines 20 running the length of the bottom panel 10. The side panels 12 have two parallel score lines 22 and 24 running the length of the side panels 12, dividing the side panels 12 into lower, middle and upper portions, 26, 28 and 30, respectively. The lower portions 26 are folded upwardly and outwardly from the bottom panel 10 along score lines 20. The middle portions 28 are folded inwardly and primarily upwardly from the lower portions 26 along score lines 22. The upper portions 30 are folded upwardly and primarily inwardly from the middle portions 28 along score lines 24. The upper edges of the upper portions 30 meet and contact with the upper free ends of the sticks in the caramel or candy apples. The mode of folding is clearly illustrated in FIG. 1. This side panel construction of upwardly, and outward then progressively inward inclination provides a configuration that complements the shape of and surrounds the caramel and candy apples, without coming into contact with the apples, thus minimizing undesireable problems of adhesion of the caramel or candy coating on the apples with the side panels of the carton.

The corner flaps 14 are integral with the lower portions 26 of the side panels 12 and foldable therewith at score lines 32. The corner panels 14 are folded inwardly perpendicular to both the bottom panel 10 and the side panels 12.

The end panels 16 are integral with the ends of the bottom panel 10 and foldable therewith at score lines 34 that run the width of the bottom panel 10. The end panels 16 have two parallel score lines 36 and 38 dividing the end panels 16 into exterior, interior and tongue portions, 40, 42 and 44, respectively. The exterior portions 40 are folded upwardly perpendicular to the bottom panel 10 outside of the corner flaps 14 along score lines 34. The interior portions 42 are then folded over the corner flaps 14 along score lines 36 and downwardly to the bottom panel 10. The tongue portions 44 are then folded along score lines 38, in the plane of the bottom panel 10. The bottom panel 10 has two U-shaped slits 46 forming tabs 48 adjacent and directed outwardly toward the ends of the bottom panel 10. The tongue portions 44 slip underneath the tabs 48 to lock the end panels 16 in place. The end panels when locked in place also serve to lock the corner flaps in place between the exterior and interior portions 40 and 42 of the end panels, thereby prohibiting relative movement between the bottom panel, the end panels and the lower portions 26 of the side panels, thereby, first, to lock the carton in basic set-up position and prevent collapse thereof, and second, to cause the bottom panel, the end panels and the lower portions of the side panels to form a set-up tray for convenient insertion and reception of the apples. The end panels 16 extend only as high as the lower portions 26 of the side panels 12, so that the remaining part of the ends of the carton, adjacent the middle and upper portions 28 and 30, remains open to permit the consumer to view the caramel or candy apples contained therein, as illustrated in FIG. 1.

The handle panels 18 are integral with the side panels 12 and foldable at score lines 50 that run the length of the side panels 12. The handle panels 18 are folded vertically upward from the upper portion 30 of the side panels 12, parallel to each other, and sandwich therebetween the sticks in the apples, as illustrated in FIG. 1. The handle panels 18 may then be fastened together by any conventional means, preferably by staples. Thus, the sticks are securely confined between the two handle panels 18 to hold the caramel or candy apples from sliding about and coming into contact with either the side panels 12 or end panels 16. The handle panels 18 also have oval shaped holes 52 cut therein to provide composite hand hold for carrying the carton. The handles are shown in FIG. 2 as having small tabs 54 adjacent the holes 52 which may be folded over to one side or the other to provide a more comfortable carrying handle.

The interior surfaces of the carton, especially the bottom panel, may be provided with a wax or similar coating to mitigate sticking which could occur should any of the caramel and candy apples slide out of place. A wax coating on the bottom 10 is desirable because the candy coated surface of the apples rest thereon. Alternatively, or in addition, small circular or cupshaped pieces of wax paper (not shown) may be inserted between the caramel and candy apples and the bottom panel 10 to prevent the apples from adhering to the bottom panel.

While the preferred embodiment of the invention has been shown and described, it is understood that various changes in details and arrangement may be made without departing from the spirit and scope of the invention, as defined in the appended claims.

What is claimed is:

1. A paperboard carton for containing, holding and carrying, in an inverted position, a plurality of caramel or candy apples each having a stick therein, comprising a unitary paperboard blank cut and scored to define and consisting essentially of:

a bottom panel having two opposing U-shaped slits, one adjacent each end of said bottom panel, and each forming a tab directed outwardly toward the respective end of the panel, the bottom panel being adapted to receive caramel or candy apples in an inverted position with their sticks pointed upwardly;

two side panels integral with and foldable along score lines at the side edges of said bottom panel, said side panels each having two lengthwise score lines therein dividing said side panels into lower, middle and upper portions, said side panels being folded at the score lines so that the lower portions extend upwardly and outwardly from said bottom panel, the middle portions extend inwardly and primarily upwardly from the lower portions and the upper portions extend upwardly and primarily inwardly from the middle portions, with the upper edges of the upper portions in contact with one another and the opposite sides of the upper ends of the sticks in the apples, said side panels thereby surrounding the side and upper surfaces of the apples without coming into contact with the apples;

two pairs of corner flaps, each pair being integral with and foldable relative to the opposite ends of the lower portion of each of said side panels along score lines perpendicular thereto, said corner flaps being foldable inwardly, perpendicular to both said side panels and said bottom panel;

two end panels integral with and foldable relative to the ends of said bottom panel along score lines perpendicular thereto, said end panels each having two lengthwise score lines therein dividing each end panels into exterior, interior, and tongue portions, said end panels being folded at their score lines so that the exterior portions extend upwardly, perpendicular to said bottom panel, outside of said corner flaps, the interior portions being folded over said corner flaps and extending downwardly inside of said corner flaps to said bottom panel and the tongue portions extending inwardly in the plane of said bottom panel, and locking underneath the tabs formed by the U-shaped slits in said bottom panel;

said bottom and end panels and the lower portions of said side panels forming a set-up tray for holding and containing the apples; and two handle panels integral with and foldable relative to the upper edges of the upper portions of said side panels, and having hand holes therethrough, said handle panels extending vertically upward parallel to each other and fastened together, thereby to therebetween sandwich the sticks of the caramel and candy apples, for holding the apples in place, the hand holes defining a composite handle for carrying the carton and the apples.

* * * * *